US005112052A

United States Patent [19]

Yamaura

[11] Patent Number: 5,112,052

[45] Date of Patent: May 12, 1992

[54] GROOVED GAME BOARD HAVING MAGNETIC SURFACE PROJECTILE AND PUZZLE OVERLAY

[75] Inventor: Toranosuke Yamaura, 31-7, Yanagihara 1-chrome, Adachi-ku, Yanagihara 1-chome, Adachi-ku, Tokyo, Japan

[73] Assignees: Yonezawa Corporation; Toranosuke Yamaura, both of Tokyo, Japan

[21] Appl. No.: 556,895

[22] Filed: Jul. 23, 1990

[30] Foreign Application Priority Data

Jul. 31, 1989 [JP] Japan ..... 1-90914[U]

[51] Int. Cl.[5] ..... A63H 18/10; A63F 9/10

[52] U.S. Cl. ..... 273/153 R; 273/108; 273/239; 273/456; 446/129

[58] Field of Search ..... 40/409, 426, 415, 657; 446/71, 137, 139, 444, 445, 446; 273/85 R, 85 E, 85 F, 108, 239, 157 A; 211/D1; 248/206.5, 309.4, 683

[56] References Cited

U.S. PATENT DOCUMENTS

| | | | |
|---|---|---|---|
| 2,956,807 | 10/1960 | Luchsinger | 273/108 |
| 2,965,235 | 12/1960 | Daline | 248/206.5 |
| 3,210,080 | 10/1965 | Rael et al. | 446/138 |
| 4,013,293 | 3/1977 | Hess et al. | 273/239 X |
| 4,079,945 | 3/1978 | Brass | 446/139 |
| 4,861,039 | 8/1989 | Phillips | 273/239 |
| 4,990,117 | 2/1991 | Yonezawa | 446/136 |

*Primary Examiner*—William H. Grieb
*Assistant Examiner*—William M. Pierce
*Attorney, Agent, or Firm*—Darby & Darby

[57] ABSTRACT

The base of a game board is formed by a mount member having a groove having a form containing straight line parts, curved line parts, intersecting parts, and angled parts. The groove forms the traveling path of a traveling toy. Solid bodies containing iron-including materials or magnetic materials are inserted into the groove of the mount member so that the upper surface of the solid bodies are leveled with the upper surface of the mount member. The mount member is affixed to a substrate and covers the entire surface of the substrate. A covering paper is affixed to the mount member and covers the entire surface of the mount member to hide the traveling path. When a traveling toy which is provided with a magnet is driven on the covering paper, the traveling toy runs along and over the solid bodies which are in the groove in the mount member which is covered by the covering paper. The covering paper comprises a jigsaw puzzle and can also be used as a book cover.

2 Claims, 3 Drawing Sheets

GROOVED GAME BOARD HAVING MAGNETIC SURFACE PROJECTILE AND PUZZLE OVERLAY

BACKGROUND OF THE INVENTION

1. Field of the Invention

The present invention relates to multipurpose boards which can be used for various purposes such as a game board on which a traveling toy can be driven, one on which jigsaw puzzles can be assembled, or as a hanger board on which cloths, hats and the like can be put, and may be used in a manner similar to the use of tapestries or similar things for covering walls, as interior ornaments, and as covers for picture books and the like.

2. Description of Related Arts

Play boards for traveling toys are known. For example, those on which traveling bodies that have a magnet run and are adapted to move when placed on an iron plate by the action of the magnet, are known. The play boards for traveling bodies have a structure such that a traveling path made of a thin iron sheet is exposedly fixed on a substrate. Therefore, these types of traveling paths fail to give a sense of unexpectedness or surprise during play because the traveling path is uncovered and can be observed visually, and the players can easily anticipate how the traveling bodies will move; or the traveling path tends to readily peel off the substrate. Because of these disadvantages, the commercial value of conventional play boards for traveling bodies have decreased.

Jigsaw puzzles are also well-known. Obviously, jigsaw puzzles cannot be used as-is as a play board for traveling bodies, or as a hanger board for cloths, hats and the like.

There are a variety of tapestries, interior ornaments, decorations, book covers, etc., which cannot, of course, be used as they are as a play board for playing with traveling bodies, jigsaw puzzles, or the like.

SUMMARY OF THE INVENTION

The present invention has been made in view of the above points and has as an object to provide a multipurpose board which can be used for a variety of purposes such as, for example, a play board for playing with traveling bodies, a hanger board for cloths, hats, and other small objects, as well as for tapestries, interior ornaments, and the like.

As a result of intensive investigation, it has now been found that the above-described object can be solved by the provision of a covering paper in order to hide the traveling path of a board which can be used as a play board for traveling bodies.

That is, the present invention provides a board comprising a substrate having provided thereon a support member or a mount, a solid body, and a covering paper, the covering paper being adapted for hiding the mount and the solid body.

The multipurpose board of the present invention can be used in a variety of applications such as a play board on which the traveling path is not visible or is masked, a play board for a jigsaw puzzle, a hanger board, a hanging article, an interior ornament, and the like.

Therefore, the board of the present invention is convenient and has general-purpose properties, which can be used both as an article for children and as one for adults.

The above object and other objects, effects, features and advantages of the present invention will become more apparent from the following description of embodiments thereof taken in conjunction with the accompanying drawings.

DETAILED DESCRIPTION OF THE EMBODIMENTS

When a single layer of paper is used as the covering paper and a traveling path made of iron as the magnetically active member is used as the solid body, a traveling body provided with a magnet as a counterpart of the magnetically active member, can be run on the board which seems ordinary and featureless due to the invisibility of the solid body. When jigsaw puzzle pieces are used as the covering layer, and the solid bodies used form a traveling path, the traveling of the traveling body and the assembly of a jigsaw puzzle are possible with the same board. Alternatively, when the single layer of paper or jigsaw puzzle pieces are used as the covering and a magnet or an iron piece is used as the solid body, the board can be used as a hanger board, simultaneously using the magnet or the iron piece as a magnetically active member, which is adapted to be absorbed and thus serves as a hook on which a desired article is to be hung. In another possibility, the board of the present invention can be used as a hanger board when the single layer of paper or the above-described jigsaw pieces are used as the covering layer and the solid bodies used are made of a non-ferrous metal to which can be attached one or more hooks. Furthermore, the board of the present invention can be used as a cover for a book, as well as a travel board on which and where the traveling path described above is defined by solid bodies. The board may have binding metal, or a binding hole and use a binding thread. Alternatively, the board can be used as a tapestry-like hanging ornament, an interior ornament or the like, by using the single layer of paper or the above-described pieces as the covering layer, fitting the pieces on the boards and then sticking and fixing the pieces on the board with a paste or an adhesive, as is well-known.

Figure 1:
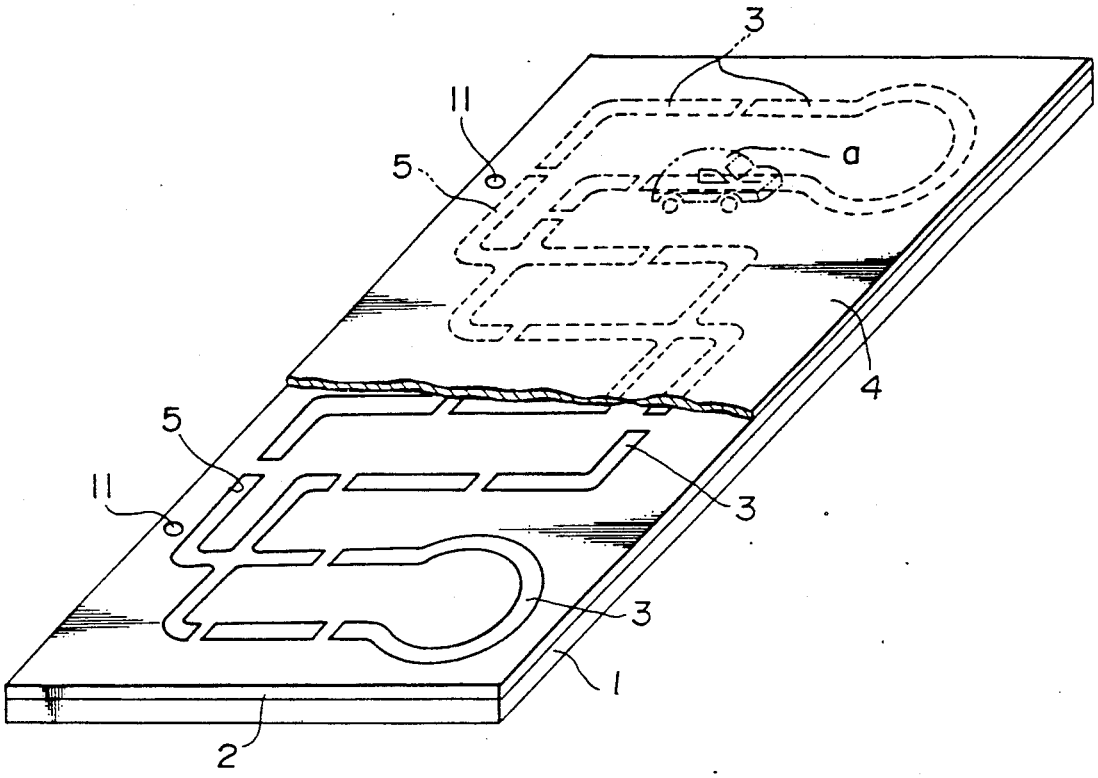
FIG. 1 is a partial cut-off perspective view showing a multipurpose board according to a first embodiment of the present invention.
Figure 2:
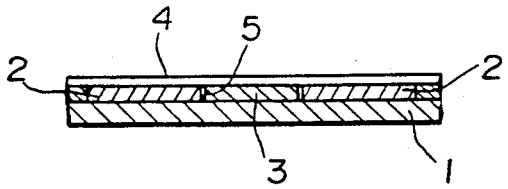
FIG. 2 is an enlarged cross-sectional view of the multipurpose board shown in FIG. 1.

FIGS. 1 and 2 each show a multipurpose board as a play board for a traveling toy according to a first embodiment of the present invention. In FIG. 1, a substrate 1 supports thereon a support member or mount 2 and one or more solid bodies 3, and covering paper 4 is arranged on the mount and solid body so as to cover or mask them. The substrate 1 is a plate or board which is made of a material which does not readily decrease or attenuate magnetism of the solid body 3, such as a paperboard, a synthetic resin plate, a non-ferrous metal plate or the like. The mount 2 is used in order to compensate for differences in height between areas where the solid body is present and other areas where there is no solid body on the substrate 1. For this purpose, the mount 2 is formed with voids 5 in the form of holes or slots or some other form in accordance with the contours of the corresponding pieces which are designed to snugly fit into the voids. The mount 2, which is performed with the voids 5, is fixed onto the substrate 1 with a glue or an adhesive. The voids may be formed by cutting the mount 2 through in the form of a traveling path for driving a traveling body A (not shown}and including straight portions, curved portions, crossings or corners. The solid bodies 3 are made of a plate of a magnetic substance such as iron which has been formed so as to have respective contours which correspond to the inside forms of the respective voids 5. The solid bodies 3 are fitted in the corresponding voids 5 to form the traveling path for the traveling body A (not shown). The iron plate used for producing the solid bodies 3 has the same thickness as the mount 2 so that there is no difference in height from the surface of the substrate 1, and the surface of the cover paper 4 can form an even plane without depressions or protrusions. The cover paper 4 is of the same size as the substrate 1 and is of a single layer of paper which may have desired designs, pictures or patterns on its surface, although such are not shown in FIGS. 1 to 4. The cover paper 4 is attached with a glue or an adhesive over the entire surface of the mount 2 fitted with the solid bodies 3 and completely prevents the solid bodies 3 from being seen.

The article thus constructed has a smooth surface and would seem to be a featureless single surface, and one cannot see or feel the presence of a traveling path underneath. However, when the traveling body A is put on the cover paper 4, it moves to a place just above one of the hidden or masked solid bodies 3 which is nearest to the traveling body A by means of the magnetic force of the magnet provided in the traveling body A, and the traveling body A is then able to move along the traveling path freely due to the driving force imparted to the traveling body, for example, by an electric motor (not shown) incorporated in the traveling body A (not shown), under the influence of magnetic force between the magnet in the traveling body and the magnetic substance in the traveling path (solid bodies 3).

Because the traveling path is not visible or is masked, the player and observers may naturally be surprised by the unexpected movements of the toy. Therefore, the article or toy can provide amusement to the players and observers.

Figure 3:
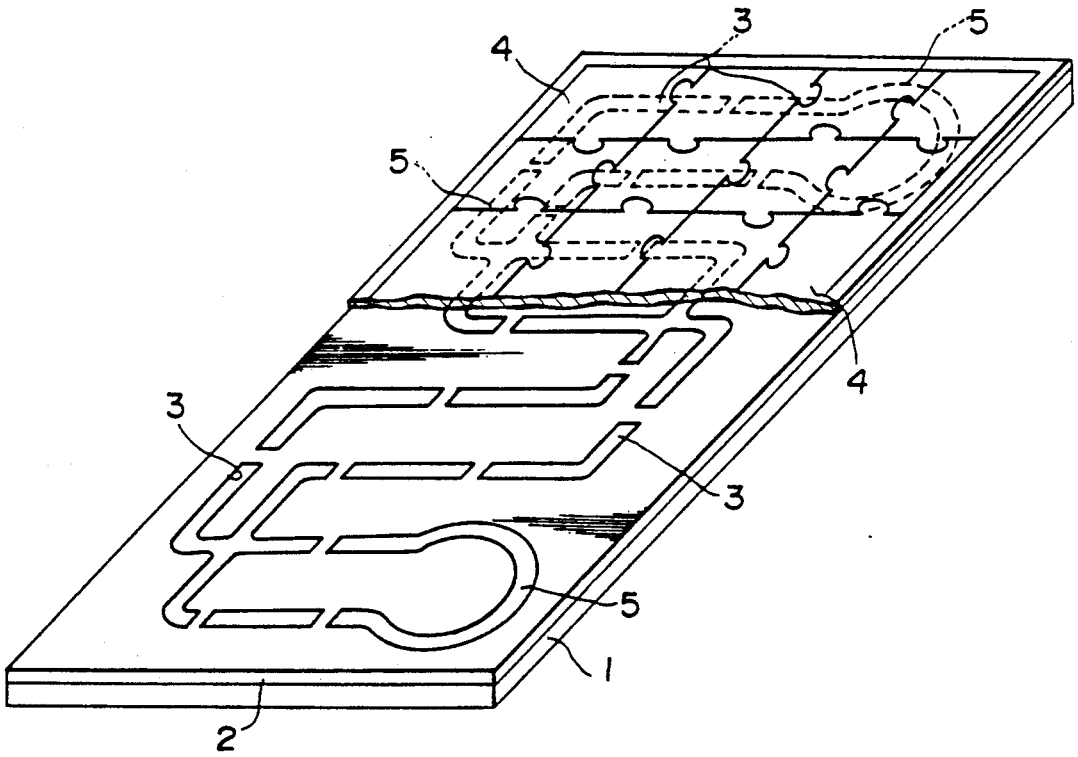
FIG. 3 is a perspective view of the board according to a second embodiment of the present invention, with parts cut away.

FIG. 3 shows a second embodiment of a play board which can be used both as a board for a traveling toy and as a jigsaw puzzle board.

The substrate 1, the mount 2 and the solid bodies 3 are generally the same as those used in the first embodiment, and explanation thereon will be omitted here. However, the cover paper 4 used in this embodiment is somewhat different from the one used in the first embodiment and explanation will focus on the differences.

The cover paper 4 is composed of a number of paper pieces. The paper pieces have printed thereon in advance parts of pictures, designs and/or letters, and when properly combined form a completed picture, design and/or letters having proper originally intended forms.

This construction makes it possible for players to assemble a jigsaw puzzle by combining the pieces so as to reconstruct the visual information and thereafter to play by driving a traveling body with a magnet (not shown) along an invisible or masked traveling path under the jigsaw puzzle pieces or along the solid bodies 3 masked by the jigsaw puzzle pieces.

In this case, the solid bodies 3 may be detachably fitted into the corresponding voids 5 or, alternatively, the solid bodies 3 may be fixed to the substrate 1 with an adhesive when they are fitted in the corresponding voids 5.

Figure 4:
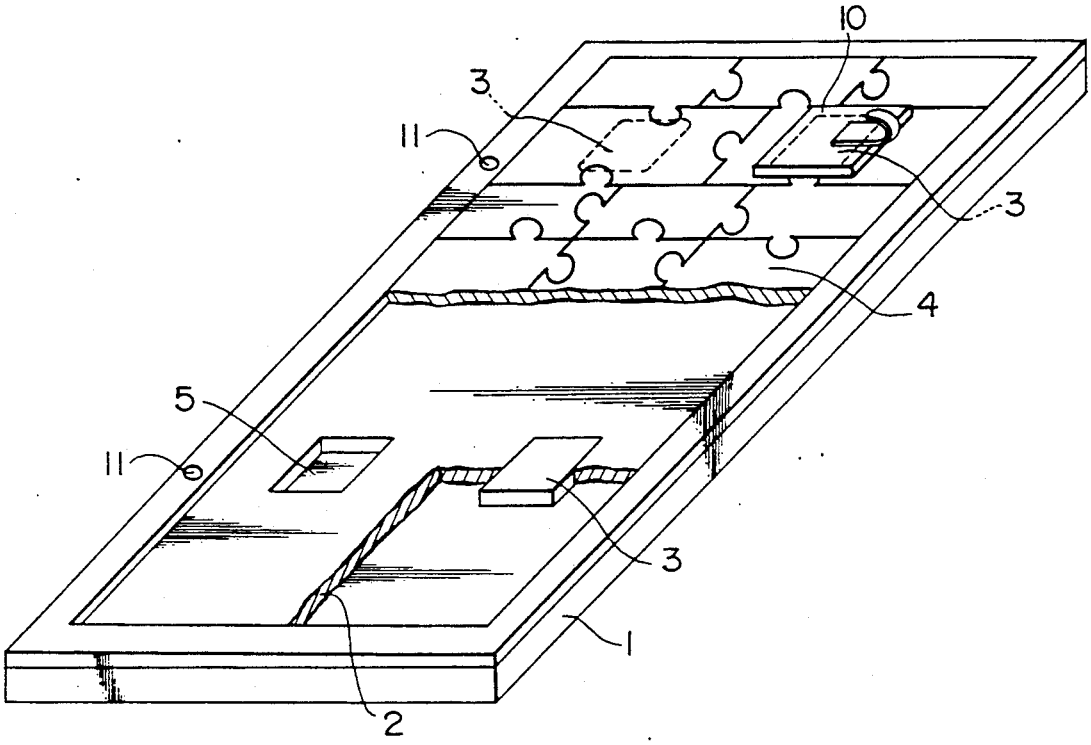
FIG. 4 is a perspective view of a multipurpose board according to a fourth embodiment of the present invention, with parts cut away.
Figure 5:
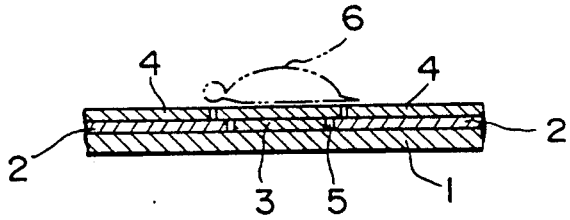
FIG. 5 is a cross-sectional view of the multipurpose board shown in FIG. 4.

FIGS. 4 and 5 illustrate a multipurpose board used as a hanger board according to a third embodiment of the present invention, in which the solid bodies 3 are made of a magnet or iron piece and jigsaw puzzle pieces are used as the covering paper 3. In this embodiment, the substrate 1 is the same as that used in the first embodiment, and the cover paper 4 is the same as that employed in the second embodiment. Therefore, explanation will focus on differences in construction between this embodiment and the previous embodiments.

The mount 2 is formed with a proper number of voids 5 at appropriate positions and then fixed with a glue or an adhesive onto the substrate 1. The solid bodies 3 are formed so as to have a shape corresponding to the forms of the corresponding voids 5 and are arranged in the voids 5 detachably or fixedly in the same manner as in the second embodiment. The solid bodies 3 are made of a magnet or iron plate of the same thickness as that of the mount 2.

The cover paper 4 may be a single layer of paper, and can be fixed onto the mount 2.

The shapes of the solid bodies 3 and those of the voids 5 are not limited to squares shown in FIGS. 4 and 5; they may also be circular, of spider-like form, in the form of various plants and animals, or in other desirable shapes.

Among the number of pieces of the covering paper 4, those pieces which are to be arranged on the solid bodies 3 are drawn somewhat larger than other pieces in the illustrated embodiment in order to clearly show the position of the solid bodies 3. However, all the pieces may be of the same size.

With the above-described construction, all the pieces, after completion of the jigsaw puzzle assembly, may be fixed as shown on the mount 2 and the solid bodies 3. If this is done, hooks each having a magnet can be held on the solid bodies 3 through the cover paper 4 if the solid bodies 3 are made of an iron pieces, or alternatively, hooks each having an iron piece can be held on the solid bodies 3 through the cover paper 4 when the solid bodies 3 are magnetic. Thus, the hooks can be held on the board firmly by magnetic attraction between the solid bodies 3 and the hooks so that the hooks can support things which are put thereon such as hats and the like. In the case where the covering paper is a single layer of paper, hooks can be firmly held on the solid bodies by magnetic attraction in the same manner as described above. The detachably held hooks as described above can be used for hanging various relatively light articles such as hats, gloves, bags and the like.

When a jigsaw puzzle is to be assembled on a board according to this embodiment, the use of three-dimensional pieces 6 provided with an iron piece or a magnet as shown in FIG. 5 will make the activity more interesting. The three-dimensional pieces may be formed so as to have the shape of an animal, a plant, a vehicle such as a car, a tram, a train or an airplane, a building or the like. The use of the three-dimensional pieces gives rise to a wholly or partly three-dimensional completed picture or design, and therefore players can enjoy an enhanced jigsaw puzzle assembly experience.

In the third embodiment, the solid bodies 3 may be made of a different material. For example, the solid bodies 3 may be made of a non-ferrous metal or of wood which has the same thickness as that of the mount 2, and some of the solid bodies 3 may be performed with a screw tap (not shown). All the solid bodies 3, including those provided with a screw tap, are fitted in the corresponding voids 5 in the same manner as in the previous embodiments, and then the cover paper 4 is attached thereon as well as the mount 2. In this case, hooks with a male screw can be engaged with the screw tap of the solid bodies 3 in order to firmly fix them to the board. Thus, the board can be used as a hanger board.

Hereinafter, a multipurpose board according to a fourth embodiment of the present invention is explained. This board is used as a binder for hooks. As in the construction of the first embodiment or the second embodiment, all the pieces of the cover paper 4 are fixed to the mount 2 and the solid bodies 3; a number of pieces of paper are arranged so as to be sandwiched between two boards of the present invention such that the respective cover papers 4 are placed on the outer side or on the open side, and one side of the boards are bound by metal fasteners. Alternatively, a number of binding holes may be formed along one end of each of two boards of the present invention, and after sandwiching a number of pieces of paper formed with a corresponding number of holes between the two boards, the holes with the side provided with the cover paper 4 being outside, binding thread is passed through the holes to bind the paper with the boards. Thus, binding can be easily performed. In addition, a traveling body or toy with a magnet can be run on the binder in the same manner as in the first and second embodiments. Furthermore, the board of the present invention can serve both as a book binder and as a jigsaw puzzle board.

In the case of the construction as in the first embodiment or in the second embodiment in which all the pieces of the cover paper 4 are fixed on the mount 2 and the solid bodies 3, the resulting board may be used as it is as a wall hanging the way a tapestry or as an interior ornament is used.

The invention has been described in detail with respect to embodiments, and it will be apparent from the foregoing to those skilled in the art that changes and modifications may be made without departing from the invention in its broader aspects, and ti is the intention, therefore, in the appended claims to cover all such changes and modifications as fall within the true spirit and scope of the invention.

What is claimed is:

1. A multipurpose board for use as a game board on which a traveling toy can be driven and jigsaw puzzles can be assembled, as a hanger board on which items can be hung, as a wall covering, and as a book cover, said multipurpose board comprising:

a substrate sheet having a predetermined size;

a support member having a size substantially equal to the predetermined size of said substrate sheet and secured thereon, said support member having upper and lower surfaces and a plurality of grooves extending from the upper surface to the lower surface, said plurality of grooves having straight line groove portions, curved line groove portions, crossing groove portions, and angled groove portions arranged with respect to each other so as to define a traveling path for the traveling toy;

a plurality of solid bodies composed of one of an iron-containing material and a magnetic material, and fitted into said grooves so that upper surfaces of said solid bodies are co-planar with the upper surface of said support member; and means for covering said support member and hiding said upper surface thereof, said covering means comprising a jigsaw puzzle comprising a plurality of interlocking pieces.

2. A multipurpose board according to claim 1 wherein said board has top and bottom surfaces, peripheral edges and a plurality of holes in proximity of said edges, said holes extending through said substrate sheet and said support member and communicating between said top and bottom surfaces for receiving bookbinding means adapted to pass through said holes whereby said board can be used as a book-cover.

* * * * *